US011624496B1

(12) United States Patent
Wang

(10) Patent No.: US 11,624,496 B1
(45) Date of Patent: Apr. 11, 2023

(54) LAMP WITH IMPROVED LAMP SOCKET STRUCTURE

(71) Applicant: DONGGUAN GUANYI LIGHT-DECORATION CO., LTD., Dongguan (CN)

(72) Inventor: Shifang Wang, Dongguan (CN)

(73) Assignee: DONGGUAN GUANYI LIGHT-DECORATION CO., LTD., Dongguan (CN)

( * ) Notice: Subject to any disclaimer, the term of this patent is extended or adjusted under 35 U.S.C. 154(b) by 0 days.

(21) Appl. No.: 17/714,153

(22) Filed: Apr. 6, 2022

(30) Foreign Application Priority Data

Mar. 18, 2022 (CN) ..... 202220596373.X

(51) Int. Cl.
*F21V 17/12* (2006.01)
*F21V 23/00* (2015.01)
*F21S 4/10* (2016.01)

(52) U.S. Cl.
CPC ..... *F21V 17/12* (2013.01); *F21S 4/10* (2016.01); *F21V 23/002* (2013.01)

(58) Field of Classification Search
CPC .... F21V 17/12; F21V 23/002; F21V 19/0005; F21V 23/06; F21V 17/164; F21S 4/10
See application file for complete search history.

(56) References Cited

U.S. PATENT DOCUMENTS 7,666,036 B1 * 2/2010 Zou ..... F21S 4/10 362/653
9,752,763 B2 * 9/2017 Lin ..... H02G 15/117
2009/0080195 A1 * 3/2009 Huang ..... F21V 31/005 362/267
2015/0211727 A1 * 7/2015 Loomis ..... F21V 3/02 362/375

* cited by examiner

*Primary Examiner* — Matthew J. Peerce

(57) ABSTRACT

The present invention relates to the field of lamp technologies, and in particular to a lamp with improved lamp socket structure. The lamp includes an inner lamp socket which is connected to the first conducting wire and is made of rubber. A conductive terminal group is set inside the inner lamp socket. An integrally formed outer lamp socket is nested outside the inner lamp socket. A conducting wire hole is set in the outer lamp socket. An opening is set in the outer lamp socket. The lamp features the following advantages: 1, a metal socket is not necessary to be set, so that production cost is effectively reduced; 2, a vertical conducting wire is set, so that the lamp can be freely adjusted, with high flexibility and better decorative effect; and 3, with an indirect structure, the lamp enjoys a pleasant appearance.

7 Claims, 7 Drawing Sheets

LAMP WITH IMPROVED LAMP SOCKET STRUCTURE

TECHNICAL FIELD

The present invention relates to the field of lamp technologies, and in particular, to a lamp with improved lamp socket structure.

BACKGROUND ART

With the development of modern society, electric power has been basically universal. Being widely used in daily life and recreational activities, lamps have been one of the indispensable items in people's daily life. Based on different needs of users for lamps, various lamps have been sprung up in our views.

Lamp holder, also named as lamp socket, is an important constituent part of a lamp. A large variety of lamp holders of decorative lamps can be seen in the existing market, but there are still some shortcomings during the manufacturing of conventional lamp holders. For example, a metal sleeve needs to be nested inside the lamp holder for connecting lamp bulb during the manufacturing process of lamp holder, so that a great amount of metal materials need to be used, with high cost for the manufacturing of the lamp. In addition, the assembly process is complex with low production efficiency, falling short of meeting the needs of people. In view of this, the inventor proposes a new invention.

Technical Solution of the Invention

To overcome the shortcomings in the prior art, the present invention provides a lamp with improved lamp socket structure. The lamp features low manufacturing cost and high efficiency.

To achieve the objective, the present invention provides a lamp with improved lamp socket structure. The lamp includes an inner lamp socket, which is connected to the first conducting wire and is made of rubber. A conductive terminal group which is in contact with lamp bulb is set inside the inner lamp socket. An integrally formed outer lamp socket made of plastic material is nested outside the inner lamp socket. A conducting wire hole for allowing the first conducting wire to pass through is set in the outer lamp socket. An opening through which the lamp bulb is mounted on the inner lamp socket is set in the outer lamp socket.

Further, the inner lamp socket includes a socket body and a tail cover mutually clamped with the socket body. A first wire accommodating slot is set in the socket body, a wire pressing strip which abuts against the first conducting wire is set in the tail cover. A second wire accommodating slot is further set in the tail cover, and a fastening part for fastening the first conducting wire is set in the second wire accommodating slot.

Preferably, the first conducting wire is connected to a second conducting wire.

Further, a first wiring terminal and a second wiring terminal are set on a position on which the second conducting wire is electrically connected to the first conducting wire. The first wiring terminal and the second wiring terminal are equipped with a clamping part respectively for fixedly connecting the second conducting wire.

Preferably, a wire holder is in sleeve connection to a position on which the first conducting wire is connected to the second conducting wire. The wire holder includes a first housing and a second housing which are clamped with each other. The first housing and the second housing are equipped with a first channel respectively for allowing the first conducting wire and the second conducting wire to pass through and fastening the first conducting wire and the second conducting wire.

Further, two first positioning holes are at least set in the first housing, and the first positioning columns matched with the first positioning holes are set on the second housing. A plurality of second positioning columns are further set on the first housing, and second positioning holes matched with the second positioning columns are set in the second housing.

Preferably, a stop piece for preventing the first wiring terminal and the second wiring terminal from being in contact with each other is set on each of the first housing and the second housing.

Further, a wiring sleeve is further in sleeve connection outside the wire holder, and a second channel for allowing the first conducting wire and the second conducting wire to pass through is further set in the wiring sleeve.

Preferably, a plurality of first protrusions are further set outside each of the first housing and the second housing, and blocking positions adaptive to the first protrusions are further set in the wiring sleeve.

Preferably, a plurality of second protrusions facilitating mounting of the lamp bulb are set outside the outer lamp socket; and skid-proof stripes are further set outside the lamp holder.

The beneficial effects: compared with the prior art, the lamp with improved lamp socket structure in the present invention includes an inner lamp socket, where the inner lamp socket is connected to a first conducting wire and is made of rubber. A conductive terminal group which is in contact with a lamp bulb is set inside the inner lamp socket. An integrally formed outer lamp socket made of a plastic material is nested outside the inner lamp socket. A conducting wire hole for allowing the first conducting wire to pass through is set in the outer lamp socket. An opening through which the lamp bulb is mounted on the inner lamp socket is set in the outer lamp socket. The invention has the following advantages: firstly, a metal socket is not necessary to be set inside the lamp socket, so that production cost is effectively reduced; secondly, a vertical conducting wire is set between the lamp socket and the wire holder, so that a lamp connected onto the conducting wire can be freely adjusted in position, with high flexibility and better decorative effect; and thirdly, with an indirect structure, the lamp enjoys a pleasant appearance.

REFERENCE NUMERALS

Figure 1:
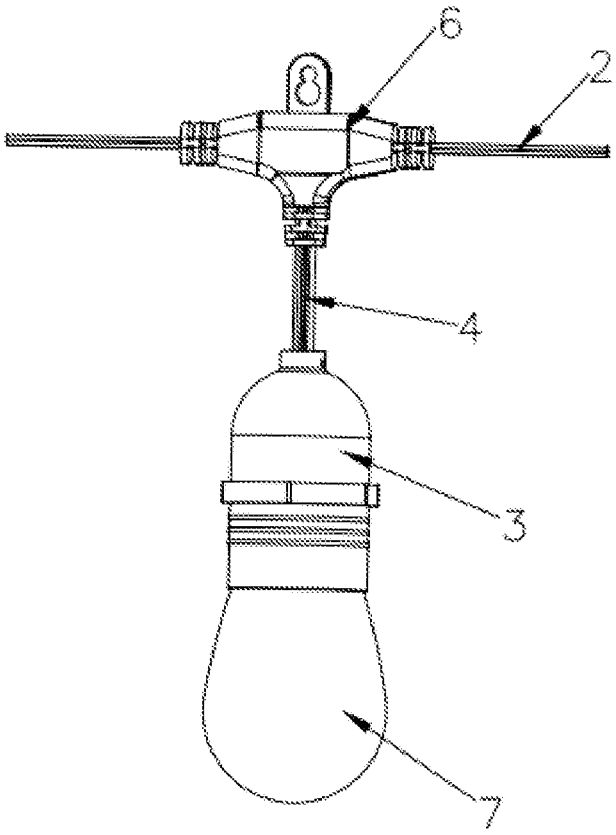
FIG. 1 is a schematic perspective view of the present invention.
Figure 2:
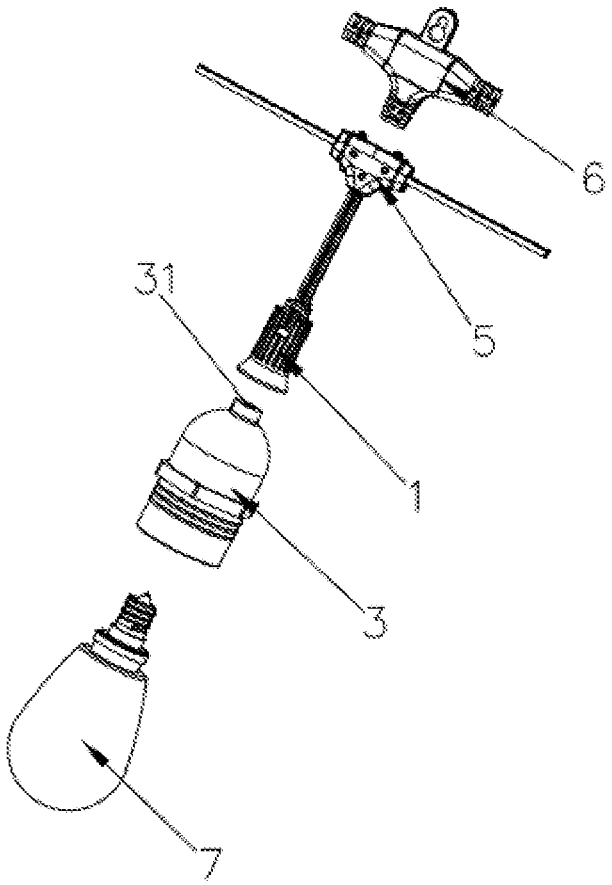
FIG. 2 is a schematic diagram showing the composition of a lamp of the present invention.
Figure 3:
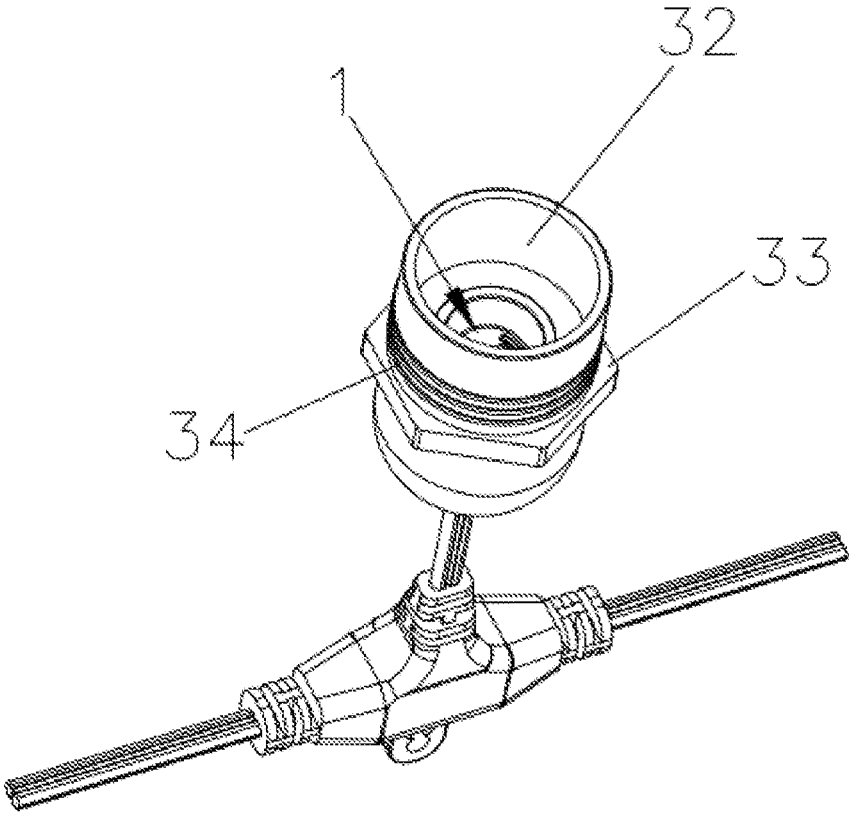
FIG. 3 is a schematic diagram of an outer lamp socket of the present invention.

1, inner lamp socket; 11, conductive terminal group; 12, socket body; 121, first wire accommodating slot; 13, tail cover; 131, wire pressing strip; 132, second wire accommodating slot; 133, fastening part; 2, first conducting wire; 3, outer lamp socket; 31, conducting wire hole; 32, opening; 33, second protrusion; 34, skid-proof strip; 4, second conducting wire; 41, first wiring terminal; 42, second wiring terminal; 43, clamping part; 5, wire holder; 51, first housing; 511, first positioning hole; 512, second positioning column; 52, second housing; 521, first positioning column; 522, second positioning hole; 53, first channel; 54, stop piece; 55, first protrusion; 6, wiring sleeve; 61, second channel; 62, blocking position; and 7, lamp bulb.

DETAILED DESCRIPTION

The present invention will be described in detail in conjunction with FIG. 1 to FIG. 10.

The present invention discloses a lamp with improved lamp socket structure. The lamp includes an inner lamp socket 1, where the inner lamp socket 1 is connected to the first conducting wire 4 and is made of rubber, a conductive terminal group 11 which is in contact with lamp bulb 7 is set inside the inner lamp socket 1, an integrally formed outer lamp socket 3 made of plastic material is nested outside the inner lamp socket 1, a conducting wire hole 31 for allowing the first conducting wire 4 to pass through is set in the outer lamp socket 3, and an opening 32 through which the lamp bulb 7 is mounted on the inner lamp socket 1 is set in the outer lamp socket 3. According to the present invention, the inner lamp socket 1 is firstly formed, then is embedded into a forming mold during production, and subjected to insert molding when the outer lamp socket 3 is formed, so that the assembly process is simplified and production efficiency is improved. In addition, the inventor adopts the inner lamp socket 1 made of rubber material and the conductive terminal to connect lamp bulb 7 instead of a conventional metal copper sleeve, so that the production cost is greatly reduced and the production needs of enterprises can also be met.

In the technical solution, the inner lamp socket 1 includes the socket body 12 and the tail cover 13 mutually clamped with the socket body 12, and a first wire accommodating slot 121 is set in the socket body 12. While being used, the first conducting wire 4 passes through the first wire accommodating slot 121, and the conductive terminal group 11 pierces through the first conducting wire 4 to conduct a circuit. The socket body 12 and the tail cover 13 are mutually clamped to firmly fasten the first conducting wire 4. To further fasten the first conducting wire 4, the wire pressing strip 131 which abuts against the first conducting wire 4 is set on the tail cover 13 to prevent the wire from moving, so that the wire pressing effect is better. A second wire accommodating slot 132 is further set in the tail cover 13. The fastening part 133 for fastening the first conducting wire 4 is set inside the second wire accommodating slot 132, so that in use, the fastening part 133 is inserted into the middle of the first conducting wire 4 for fastening the conducting wire. The second wire accommodating slot 132 is mainly used to fasten one end of the first conducting wire 4, so that the end of the conducting wire is prevented from moving.

To further improve the flexibility and decorative effect of the lamp, the first conducting wire 4 is electrically connected to the second conducting wire 2. Refer to FIG. 1, the second conducting wire 2 is perpendicular to the first conducting wire 4. In a family party held in an outdoor place, the lamp cannot illuminate every dark corner at night, and therefore, the inventor additionally sets the second conducting wire 2 on which the first conducting wire 4 is disposed in the form of a branch. When certain position needs to be illuminated, the user may swing the lamp from one position to another. Therefore, the lamp enjoys higher flexibility and better decorative effect. It should be noted that, in the technical solution, the first conducting wire 4 and the second conducting wire 2 each have double electric wires therein, one is a positive electrode and the other is a negative electrode, so as to ensure a circuit can be smoothly conducted.

Figure 5:
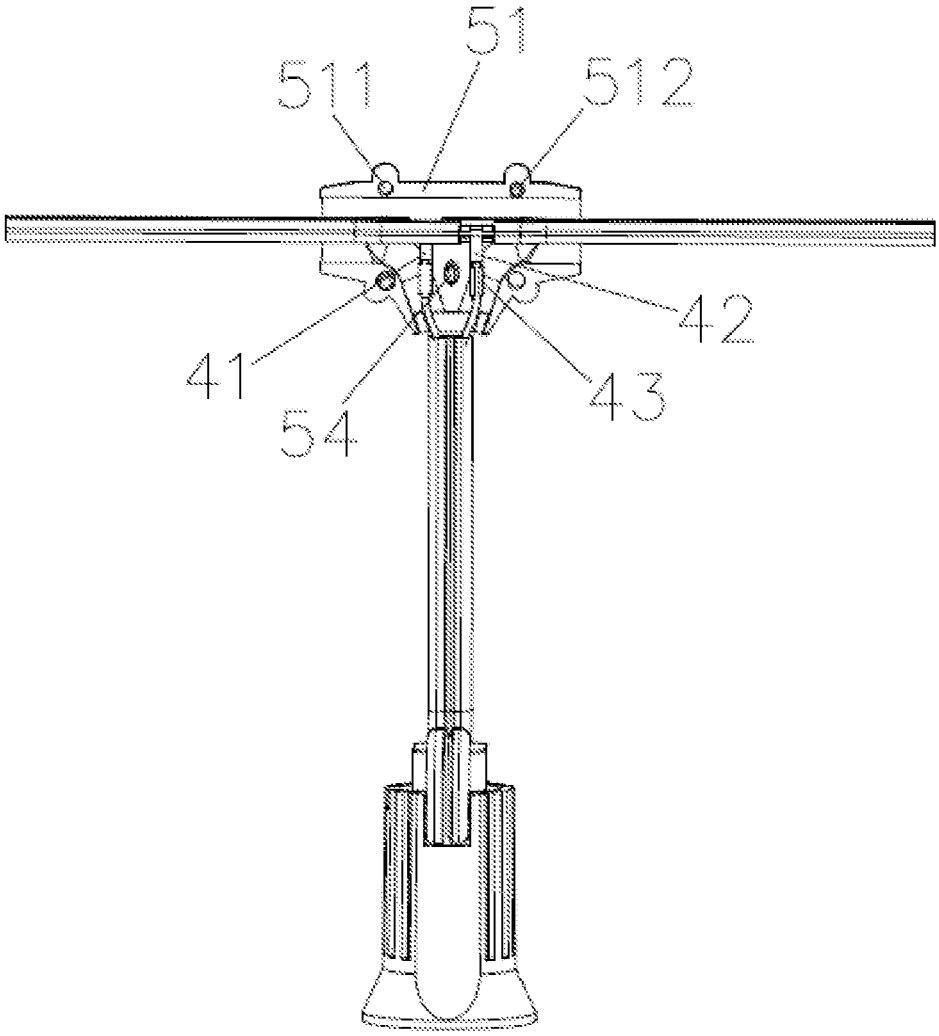
FIG. 5 is a schematic diagram of the structure of the first housing of the present invention.
Figure 6:
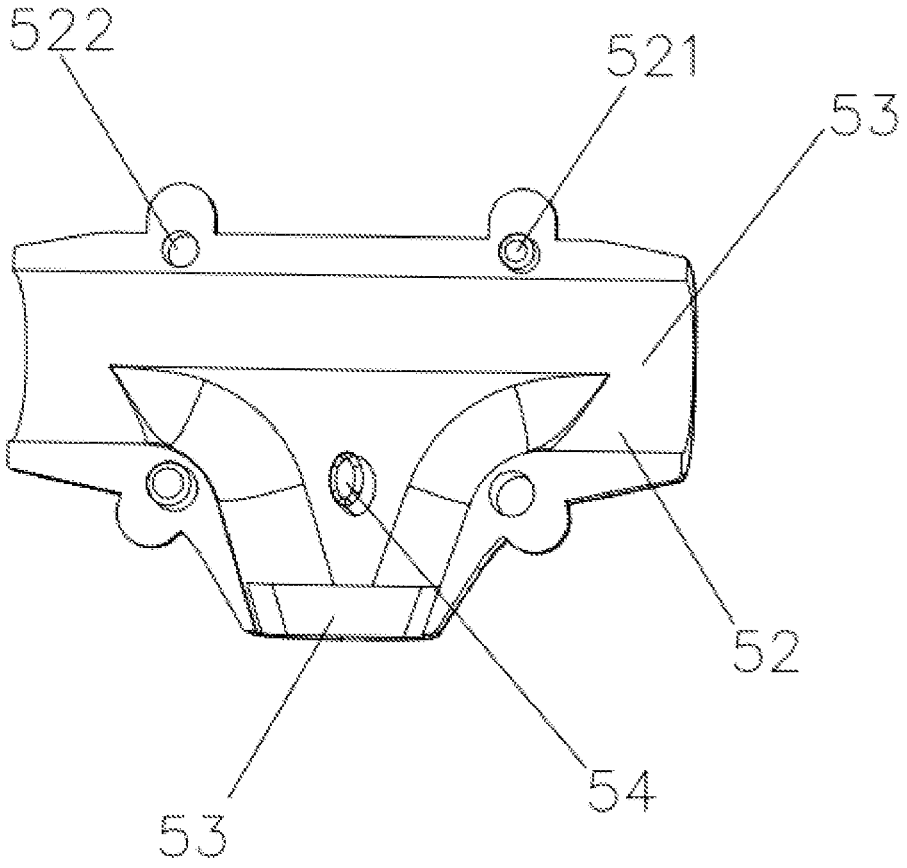
FIG. 6 is a schematic diagram of the structure of the second housing of the present invention.
Figure 7:
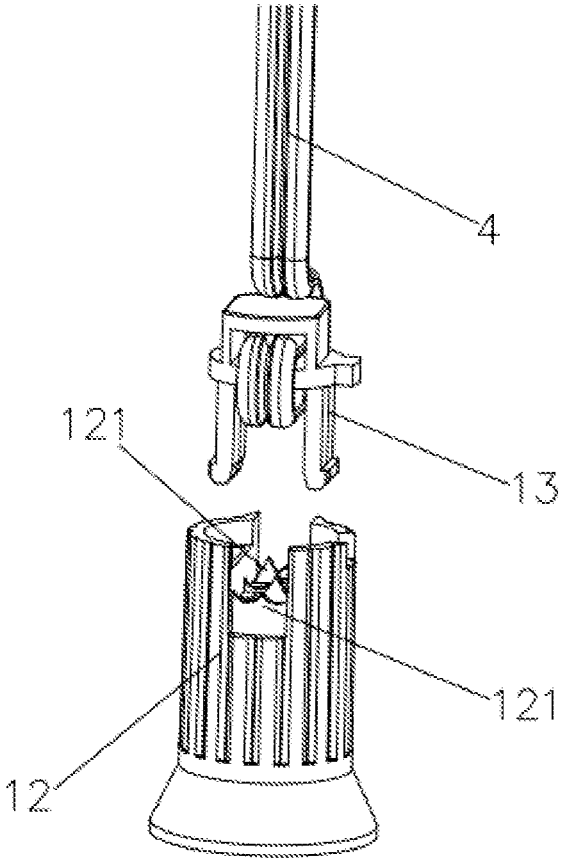
FIG. 7 is a schematic diagram of the structure of an inner lamp socket of the present invention.
Figure 8:
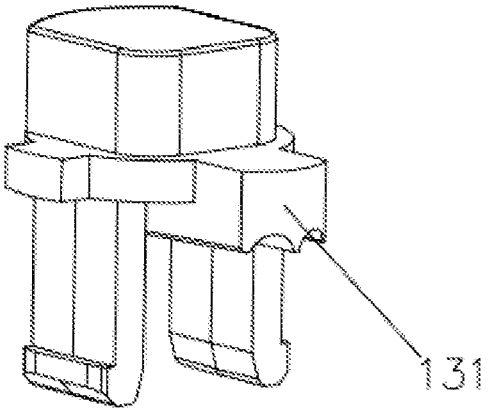
FIG. 8 is a structural diagram of the structure of a tail cover of the present invention.
Figure 9:
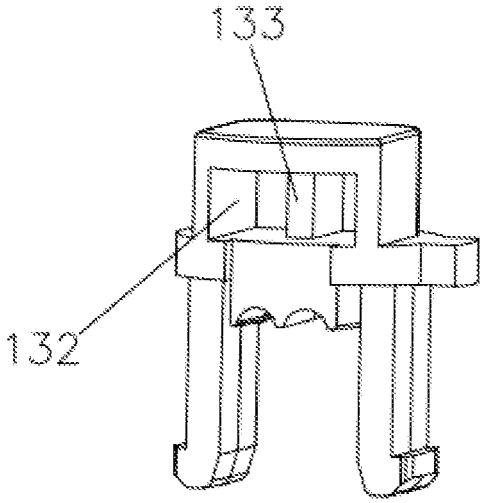
FIG. 9 is a schematic diagram of the structure of a second wire accommodating slot of the present invention.
Figure 10:
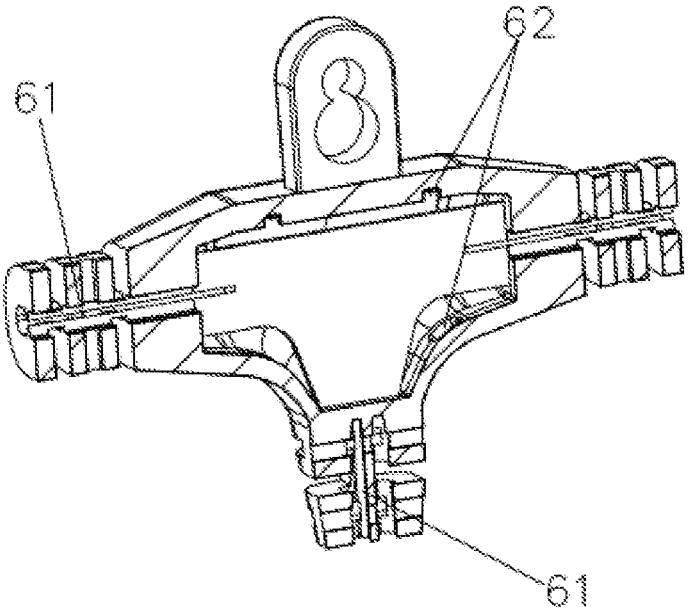
FIG. 10 is a schematic diagram of the structure of a section-view of a wiring sleeve of the present invention.

As shown in FIG. 5, the first wiring terminal 41 and the second wiring terminal 42 are set on a position on which the second conducting wire 2 is electrically connected to the first conducting wire 4. The first wiring terminal 41 and the second wiring terminal 42 are equipped with the clamping part 43 respectively for fixedly connecting the first conducting wire 4. In the technical solution, the first wiring terminal 41 is used as a positive electrode of the circuit and the second wiring terminal 42 is used as a negative electrode of the circuit to electrically connect to the second conducting wire 2 respectively. In this way, the lamp can be electrified for use normally.

To ensure the connection stability between the first conducting wire 4 and the second conducting wire 2, the wire holder 5 is in sleeve connection to the position on which the first conducting wire 4 is connected to the second conducting wire 2. The wire holder 5 includes a first housing 51 and a second housing 52 which are clamped with each other. The first housing 51 and the second housing 52 are equipped with a first channel 53 respectively for allowing the first conducting wire 4 and the second conducting wire 2 to pass through and fastening the first conducting wire and the second conducting wire. The first conducting wire 4 and the second conducting wire 2 connected through wiring terminals are poor in stability and are easy to disconnect, so that the lamp cannot be normally used. Therefore, the wire holder 5 needs to be set for fastening the position on which the first conducting wire 4 is connected to the second conducting wire 2, to improve the connection firmness. In use, the first conducting wire 4 and the second conducting wire 2 only need to be put into the corresponding first channels 53, and then the first housing 51 and the second housing 52 are closed. In the technical solution, the first housing 51 and the second housing 52 are made into the wire holder 5 by clamping, or may be manually clamped, or also can be assembled conveniently through a machine.

In the technical solution, two first positioning holes 511 are at least set in the first housing 51, and the first positioning columns 521 matched with the first positioning holes 511 are set on the second housing 52. A plurality of second positioning columns 512 are further set on the first housing 51, and second positioning holes 522 matched with the second positioning columns 512 are set in the second housing 52. By disposing the positioning columns and the positioning holes, on the one hand, the first housing 51 and the second housing 52 can be connected with each other. On the other hand, the first housing 51 and the second housing 52 can be quickly positioned and assembled. When a worker assembles the wire holder 5, assembly errors can be effectively avoided, so that the production efficiency is greatly improved.

As an embodiment, the stop piece 54 for preventing the first wiring terminal 41 and the second wiring terminal 42 from being in contact with each other is set on each of the first housing 51 and the second housing 52. The first wiring terminal 41 and the second wiring terminal 42 are respectively used as positive and negative electrodes of the circuit to connect the first conducting wire 4, so as to ensure that the lamp can be normally used. While using the lamp, the first wiring terminal 41 and the second wiring terminal 42 cannot be in contact with each other. The first wiring terminal 41 and the second wiring terminal 42 are made of metal material with low resistance, which could easily cause a short circuit when in contact with each other. The stop piece 54 can be set to avoid this risk.

In this technical solution, the wiring sleeve 6 is further in sleeve connection outside the wire holder 5, and a second channel 61 for allowing the first conducting wire 4 and the second conducting wire 2 to pass through is further set in the wiring sleeve 6. The wire holder 5 is mainly used to protect the firmer connection between the first conducting wire 4 and the second conducting wire 2, so as to prevent a short circuit. The wiring sleeve 6 can be additionally set to protect the wire holder 5, so that product stability can be further ensured. In addition, as decoration is mostly needed for the lamp, the wiring sleeve 6 can further improve the pleasant appearance of the lamp.

Figure 4:
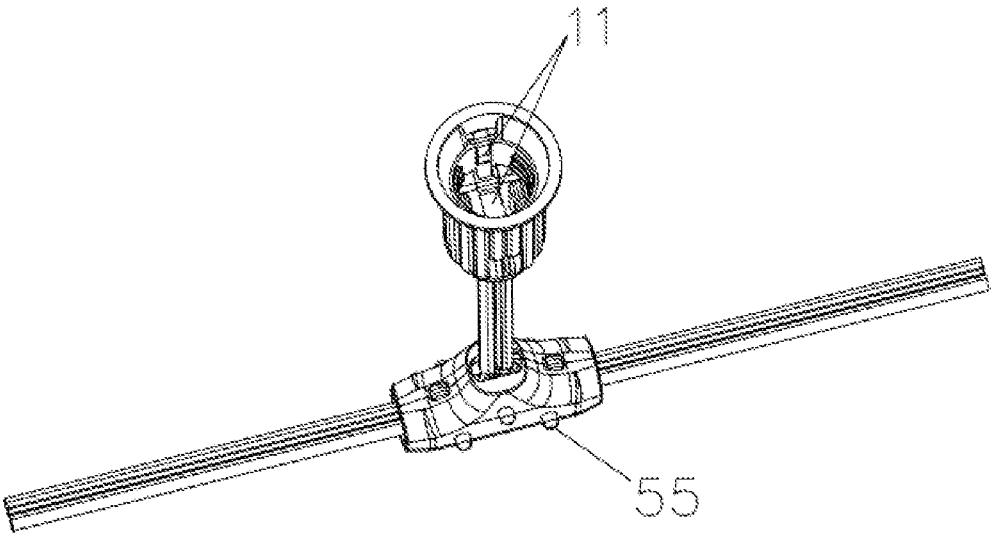
FIG. 4 is a structural diagram of the structure of a conductive terminal group of the present invention.

As shown in FIG. 4, a plurality of first protrusions 55 are further set outside each of the first housing 51 and the second housing 52, and blocking positions 62 adaptive to the first protrusions 55 are further set in the wiring sleeve 6. The wiring sleeve 6 is in sleeve connection on the wire holder 5, and the two can be connected more firmly through the protrusions.

As preferably, a plurality of second protrusions 33 facilitating the mounting of lamp bulb 7 are set outside the outer lamp socket 3; and skid-proof stripes 34 are further set outside the outer lamp socket 3. In the technical solution, the lamp bulb 7 is connected to the inner lamp socket 1, and the inner lamp socket 1 and the outer lamp socket 3 are integrally formed. When the lamp bulb 7 needs to be replaced, the lamp can only be dismounted with certain force. In this case, the protrusions and the skid-proof stripes 34 can increase force of friction between hands and the outer lamp socket 3 to facilitate the mounting and dismounting of the lamp bulb 7.

The above content is only a preferred embodiment of the present invention, and those skilled in the art may make a change in the specific embodiment and the range of application according to the idea of the present invention. The content of the present invention should not be construed as a limit to the present invention.

The invention claimed is:

1. A lamp with improved lamp socket structure, comprising an inner lamp socket (1), wherein the inner lamp socket (1) is connected to a first conducting wire (4) and is made of rubber, a conductive terminal group (11) which is in contact with a lamp bulb (7) is set inside the inner lamp socket (1), an integrally formed outer lamp socket (3) made of plastic material is nested outside the inner lamp socket (1), a conducting wire hole (31) for allowing the first conducting wire (4) to pass through is set in the outer lamp socket (3), and an opening (32) through which the lamp bulb (7) is mounted on the inner lamp socket (1) is set in the outer lamp socket (3)

wherein the inner lamp socket (1) comprises a socket body (12) and a tail cover (13) mutually clamped with the socket body (12), a first wire accommodating slot (121) is set in the socket body (12), a wire pressing strip (131) which abuts against the first conducting wire (4) is set in the tail cover (13), a second wire accommodating slot (132) is further set in the tail cover (13), and a fastening part (133) for fastening the first conducting wire (4) is set in the second wire accommodating slot (132);

a wire holder (5) is in sleeve connection to a position on which the first conducting wire (4) is connected to the second conducting wire (2), the wire holder (5) comprises a first housing (51) and a second housing (52) which are clamped with each other, and the first housing (51) and the second housing (52) are equipped with a first channel (53) respectively for allowing the first conducting wire (4) and the second conducting wire (2) to pass through and fastening the first conducting wire (1) and the second conducting wire (2); and at least two first positioning holes (511) are set in the first housing (51), the first positioning columns (521) matched with the first positioning holes (511) are set on the second housing (52), a plurality of second positioning columns (512) are further set on the first housing (51), and the second positioning holes (522) matched with the second positioning columns (512) are set in the second housing (52).

2. The lamp with improved lamp socket structure according to claim 1, wherein the first conducting wire (4) is electrically connected to a second conducting wire (2).

3. The lamp with improved lamp socket structure according to claim 1, wherein a first wiring terminal (41) and a second wiring terminal (42) are set on a position on which the second conducting wire (2) is electrically connected to the first conducting wire (4), and the first wiring terminal (41) and the second wiring terminal (42) are equipped with a clamping part (43) respectively for fixedly connecting the first conducting wire (4).

4. The lamp with improved lamp socket structure according to claim 1, wherein a stop piece (54) for preventing the first wiring terminal (41) and the second wiring terminal (42) from being in contact with each other is set on each of the first housing (51) and the second housing (52).

5. The lamp with improved lamp socket structure according to claim 1, wherein a wiring sleeve (6) is further in sleeve connection outside the wire holder (5), and a second channel (61) for allowing the first conducting wire (4) and the second conducting wire (2) to pass through is further set in the wiring sleeve (6).

6. The lamp with improved lamp socket structure according to claim 5, wherein a plurality of first protrusions (55) are further set outside each of the first housing (51) and the second housing (52), and blocking positions (62) adaptive to the first protrusions (55) are further set in the wiring sleeve (6).

7. The lamp with improved lamp socket structure according to claim 1, wherein a plurality of second protrusions (33) facilitating mounting of the lamp bulb (7) are further set outside the outer lamp socket (3), and skid-proof stripes (34) are further set outside the outer lamp socket (3).

* * * * *